US007455185B2

(12) United States Patent
Nelson

(10) Patent No.: US 7,455,185 B2
(45) Date of Patent: Nov. 25, 2008

(54) MARTIAL ARTS BELT DISPLAY RACK

(76) Inventor: Blake A. Nelson, 6294 S. Lafayette Pl., Centennial, CO (US) 80121

( * ) Notice: Subject to any disclaimer, the term of this patent is extended or adjusted under 35 U.S.C. 154(b) by 0 days.

(21) Appl. No.: 11/076,542

(22) Filed: Mar. 8, 2005

(65) Prior Publication Data

US 2005/0211645 A1 Sep. 29, 2005

Related U.S. Application Data

(60) Provisional application No. 60/551,494, filed on Mar. 9, 2004.

(51) Int. Cl.
*A47F 7/00* (2006.01)

(52) U.S. Cl. ..... 211/85.3; 211/13.1

(58) Field of Classification Search ..... 211/85.3, 211/13.1; 242/600; 206/389, 278, 300; D6/320; 248/176.1
See application file for complete search history.

(56) References Cited

U.S. PATENT DOCUMENTS 126,967 A * 5/1872 Jurgens ..... 242/600
3,019,910 A * 2/1962 Greene ..... 211/85.3
4,109,794 A * 8/1978 Samuel et al. ..... 211/85.3
D356,003 S * 3/1995 Anderson ..... D6/570
D386,018 S * 11/1997 Tosto, Jr. ..... D6/470
D409,005 S * 5/1999 Knight ..... D6/320
6,364,129 B1 * 4/2002 Dardashti et al. ..... 211/40
D459,129 S * 6/2002 Steele ..... D6/552
D499,285 S * 12/2004 Wells ..... D6/514
2003/0146178 A1 * 8/2003 Brady ..... 211/85.3

* cited by examiner

*Primary Examiner*—Kambiz Abdi
*Assistant Examiner*—Lindsay M. Maguire
(74) *Attorney, Agent, or Firm*—Faegre & Benson, LLP

(57) ABSTRACT

A martial arts belt display rack includes a first placard, a second placard, and one or more fasteners positioned between the first placard and the second placard and adapted to position and secure the second placard a distance from the first placard. In this particular embodiment, martial arts belts can be displayed in the display rack by placing them between the first placard and the second placard, so that at least a portion of the folded martial arts belts extend past an edge of the one or both of the first placard or second placard. In addition, one or both of the first placard or the second placard can comprise any shape imaginable, including but not limited to: square, rectangle, circle, semi-circle, star, or martial arts specific shape. In some embodiments, the first placard and the second placard can have different shapes or different sizes of the same shape.

8 Claims, 10 Drawing Sheets

Figure 8b
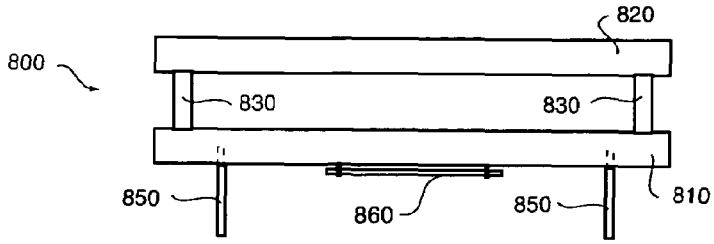
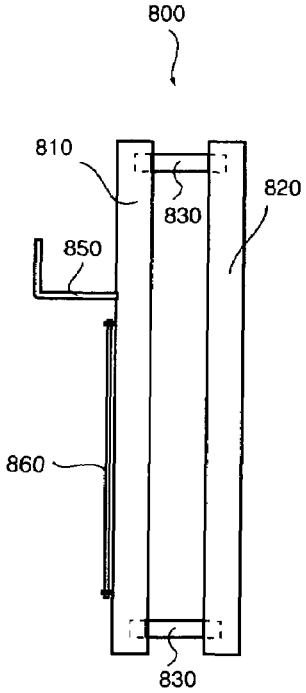
Figure 8c
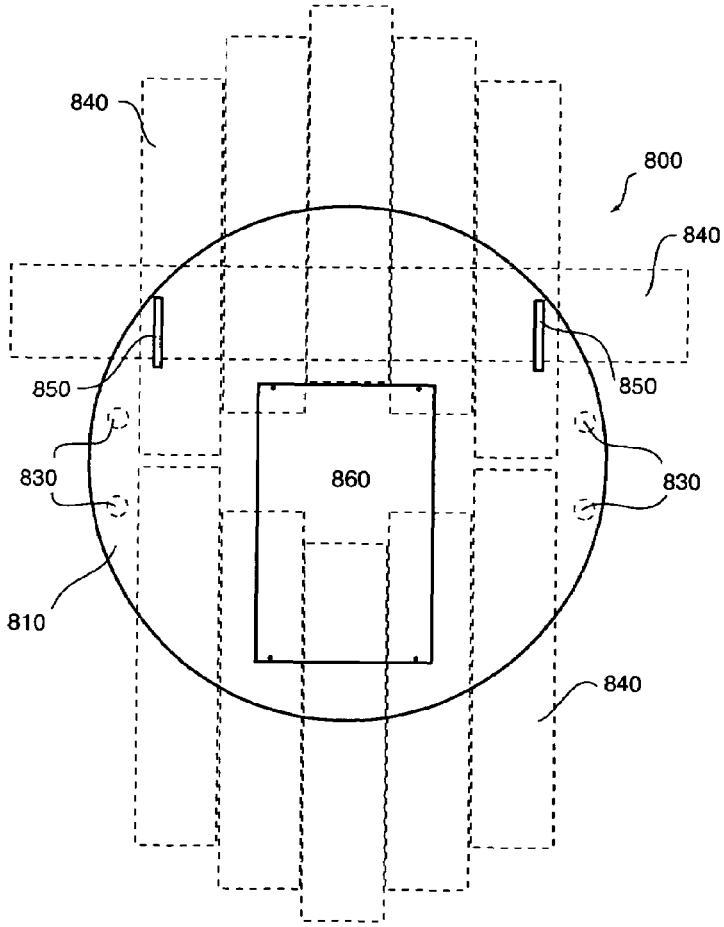
Figure 8a

Figure 9b
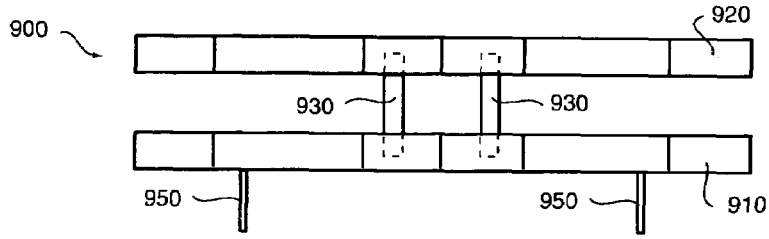
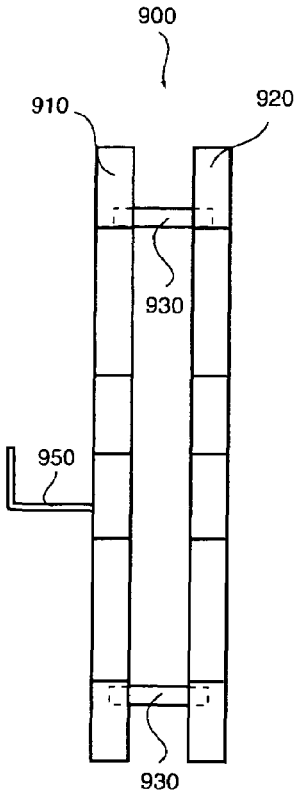
Figure 9c
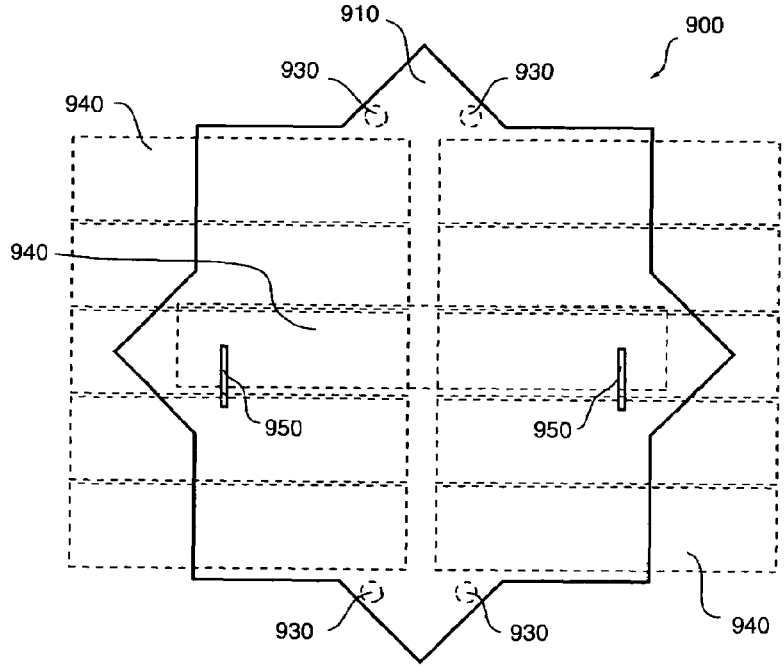
Figure 9a

MARTIAL ARTS BELT DISPLAY RACK

CROSS-REFERENCE TO RELATED APPLICATIONS

This application claims the benefit of U.S. Provisional Patent Application Ser. No. 60/551,494, filed on Mar. 9, 2004.

BACKGROUND OF THE INVENTION

The present invention relates generally to belt racks, and more particularly to racks for displaying martial arts belts.

Martial arts is becoming a very popular sport. It offers both children and adults vast benefits, including fitness, discipline, confidence, and a sense of well being. As an athlete advances up the different levels of the martial arts systems, he/she earns different colored belts to signify the athlete's level. Obtaining a new belt and the level it signifies is a great accomplishment, worthy recognition and pride.

Because obtaining a new belt is a significant accomplishment, many athletes like to display the belts in much the same way one displays trophies and medals. Given the nature and structure of belts, however, it can be difficult. Generally, a rack or display structure is needed.

Various different models of martial arts belt racks are known. The prior art belt racks, however, are not flexible. Typically, they are designed for one particular orientation and/or display option. For example, the rack might be designed to be free standing, so it cannot be wall mounted. Also, many of the prior art racks ate inflexible because they only accommodate one particular belt length. Thus, there is a need for a more flexible martial arts belt rack system.

BRIEF SUMMARY OF THE INVENTION

One embodiment of the present invention relates to a martial arts belt display rack, which comprises a first placard, a second placard, and a plurality of rows of posts positioned between the first placard and the second placard. The plurality of rows of posts are adapted to position the second placard a distance from the first placard. Martial arts belt can be displayed in the rack by placing a folded martial arts belt between two of the plurality of rows of posts.

In accordance with one embodiment of the invention, the first placard of the display rack has a first height and a first width, and the second placard of the display rack has a second height and a second width, and the second height is smaller than the first height and the second width is smaller than the first width.

In accordance with another embodiment of the invention, the bottom of the first placard is aligned with the bottom of the second placard, thus forming a base for placement on a substantially horizontal surface, such as a shelf, a desk, a countertop, or the like. Further, the first placard can include at least one mounting hole for mounting the belt rack to a wall. Also, in one embodiment, each of the rows of post comprises two posts.

In another embodiment of the invention, the middle of the width of the second placard can be approximately centered with the middle of the width of the first placard, and the middle of the height of the second placard can be approximately centered with the middle of the height of the first placard.

In still another embodiment, the present invention relates to a martial arts belt display rack, which includes a top plate assembly, a bottom plate assembly, and first and second placards secured therein. In this particular embodiment, the top plate assembly comprises a first top plate and a second top plate secured together at a defined distance from each other by one or more fasteners. Similarly, the bottom plate assembly comprises a first bottom plate and a second bottom plate secured together at a defined distance from each other by one or more fasteners. Further, the first top plate. the second top plate, the first bottom plate and the second bottom plate all include notches formed therein. In this particular embodiment, the first placard is secured between the top plate assembly and the bottom plate assembly by having a first portion of the first placard integrally positioned within the notch in the first top plate and having a second portion of the first placard integrally positioned within the notch in the first bottom placard. Similarly, the second placard is secured between the top plate assembly and the bottom plate assembly by having a first portion of the second placard integrally positioned within the notch in the second top plate and having a second portion of the second placard integrally positioned within the notch in the second bottom placard. Thus, with this particular embodiment, martial arts belts can be displayed in the display rack by placing folded martial arts belts between the first placard and the second placard.

In one embodiment of the invention, wherein one or both of the first placard and the second placard comprise a transparent material. In addition, in other embodiments, the top plate assembly can further include a plurality of posts extending upward out of the top plate assembly, so that a martial arts belt can be displayed by placing the belt in communication with the plurality of posts.

In still another embodiment, the present invention comprises martial arts belt display rack, which includes a first placard, a second placard, and one or more fasteners positioned between the first placard and the second placard and adapted to position and secure the second placard a distance from the first placard. In this particular embodiment, a martial arts belts can be displayed in the display rack by placing folded martial arts belts between the first placard and the second placard, so that at least a portion of the folded martial arts belts extend past an edge of the one or both of the first placard or the second placard. In addition, one or both of the first placard or the second placard can comprise any shape imaginable, such as, for example, square, a rectangle, a circle, a semi-circle, a star, or a martial arts specific shape. In some embodiments, the first placard and the second placard can have different shapes and/or different sizes of the same shape.

Further, in still other embodiments, the display rack can include a transparent sheet affixed to the first placard for displaying a certificate, award, picture, etc. In other embodiments, the display rack can include one or more hooks affixed to the first placard and which are operable to hold a martial arts belt on the first placard. In still other embodiments, the display rack can be configured to display belts either horizontally or vertically, and the fasteners between the first placard and the second placard can be adjustable, so that the distance between the first placard and the second placard can be adjusted.

A more complete understanding of the present invention may be derived by referring to the detailed description of preferred embodiments and claims when considered in connection with the figures.

BRIEF DESCRIPTION OF THE DRAWINGS

In the Figures, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

FIG. 8*a* is a front elevational view of still another embodiment of a martial arts belt display rack in accordance with the present invention;

FIG. 8*b* is a top elevational view of the martial arts belt display rack of FIG. 8*a;*

FIG. 8*c* is a side elevational view of the martial arts display rack of FIG. 8*a;*

FIG. 9*a* is a front elevational view of still another embodiment of a martial arts belt display rack in accordance with the present invention;

FIG. 9*b* is a top elevational view of the martial arts belt display rack of FIG. 9*a;* and FIG. 9*c* is a side elevational view of the martial arts display rack of FIG. 9*a.*

DETAILED DESCRIPTION OF THE INVENTION

Figure 1A:
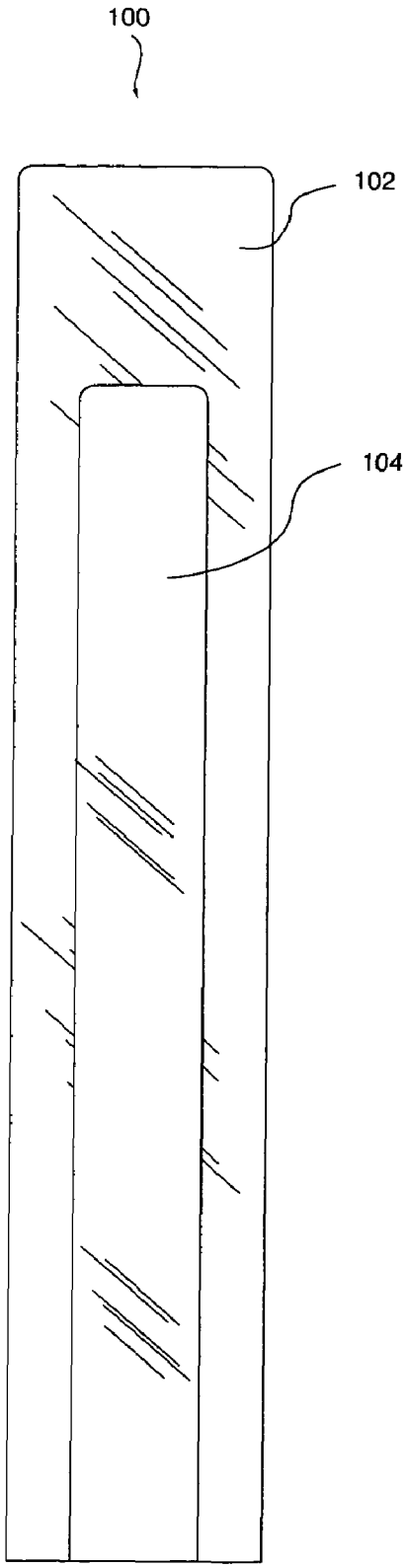
FIG. 1*a* is a front elevational view of one embodiment of a martial arts belt display rack in accordance with the present invention.
Figure 1B:
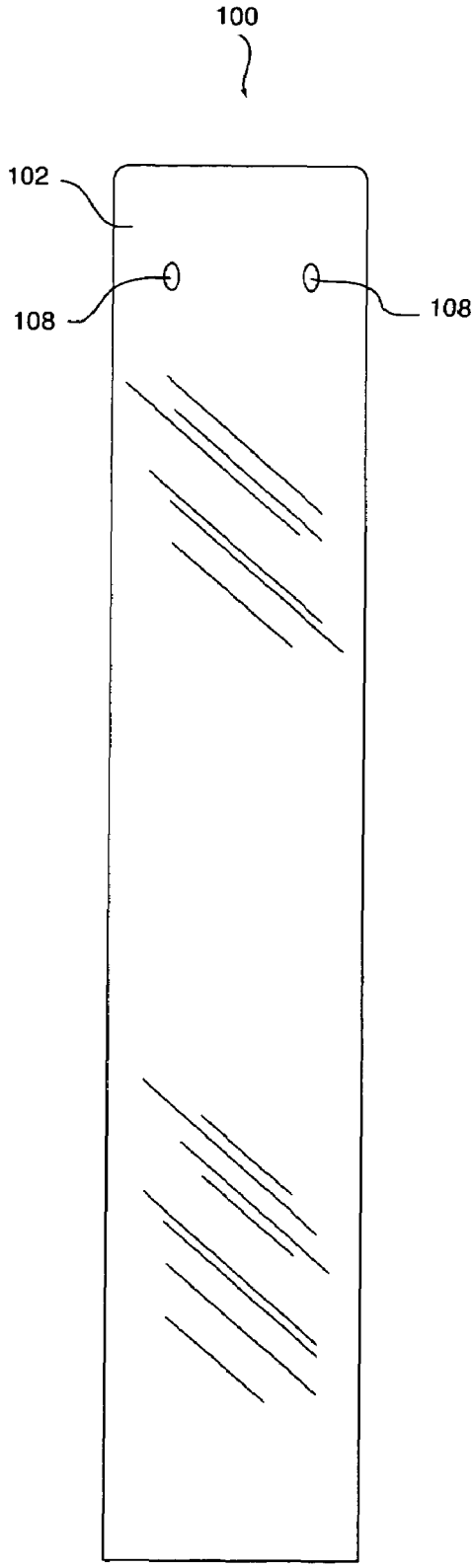
FIG. 1*b* is a back elevational view of the martial arts belt display rack of FIG. 1*a;*
Figure 1C:
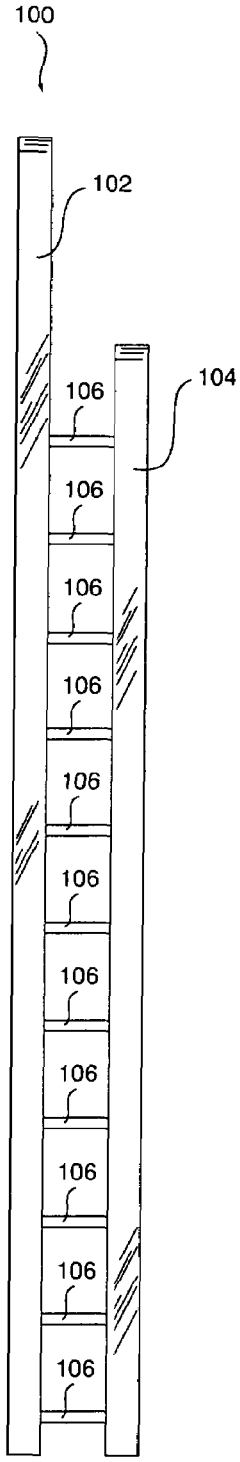
FIG. 1*c* is a left elevational view of the martial arts belt display rack of FIG. 1*a;*
Figure 1D:
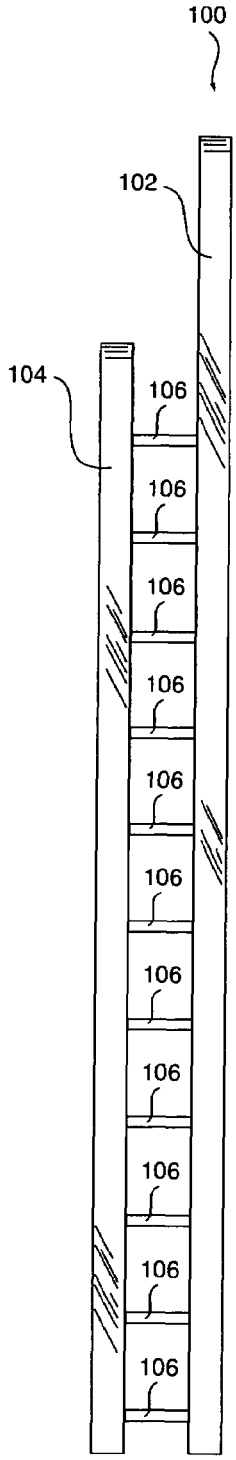
FIG. 1*d* is a right elevational view of the martial arts belt display rack of FIG. 1*a;*
Figure 1E:
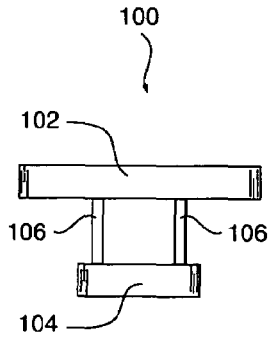
FIG. 1*e* is a top elevational view of the martial arts belt display rack of FIG. 1*a;*
Figure 1F:
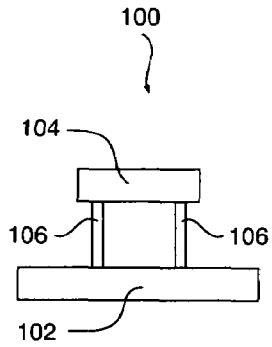
FIG. 1*f* is a bottom elevational view of the martial arts belt display rack of FIG. 1*a;*

The present invention relates to belt racks for displaying martial arts belts. The belt rack designs of the present invention can be displayed on a wall or other vertical surface, or as a free-standing display on a horizontal surface such as a desk or table. In addition, the belt racks are designed so that martial arts belt can be inserted into and removed from the display easily, without damaging the belts. Also, the belt racks comprise a simple, self contained design, which requires no loose or additional parts to insert the martial arts belt to the display. Finally, the belt racks are design to display any length belt without defacing the belts, showing the respect that all martial artists have for the martial arts belts they have earned.

Referring now to FIGS. 1*a*-1*f,* one embodiment of a martial art belt rack 100 in accordance with the present invention is show. In the illustrated embodiment, belt rack 100 comprises a base placard 102, and a front placard 104 positioned at a set distance from base placard 10. In this particular embodiment, two columns of posts 106 secure front placard 104 to base placard 102, and are set at a consistent distance apart horizontally and at a repeating interval vertically. In addition, in this particular embodiment, the bottom of base placard 102 and the bottom of front placard 104 can be set to align on a level horizontal plane, so that belt rack 100 can stand on a flat or substantially flat surface. In addition, base placard 102 can include mounting holes 108 for mounting the belt rack on a wall.

In one embodiment, a martial arts belt can be mounted in rack 100 by first folding the belt (e.g., in half 3 times), and then inserting the belt horizontally between 2 rows of posts 106. The thickness of the folded martial arts belt makes the martial arts belt fit snugly when compressed between base placard 102 and front placard 104 and secures the martial arts belt without defacing the martial arts belt. As successive martial arts belts are earned, they can be added to the display. The martial arts belt display rack can be hung flush on a wall or other vertical surface using mounting holes 108. In the embodiment illustrated in FIG. 1, the bottoms of base placard 102 and front placard 104 also can be aligned, thus forming a solid base so the martial arts belt display rack can sit on a horizontal or substantially horizontal surface, such as a desk, a counter, a shelf, or the like.

In accordance with another embodiment of the present invention, belt rack can be mounted horizontally on a wall by moving the location of the mounting holes 108 and centering or substantially centering front placard 104 in the vertical and horizontal dimensions with respect to base placard 102.

Further, in yet another embodiment, belt rack 100 can be made to longer or shorter to accommodate different number of martial arts belts.

In accordance with yet another embodiment, front placard 104 also can be held above base placard 102 by two posts 106 at the bottom of front placard 104 and two posts 106 at the top of front placard 104 leaving an unobstructed vertical space between base placard 102 and front placard 104, allowing belt rack 100 to display any width of martial arts belt.

Figure 2:
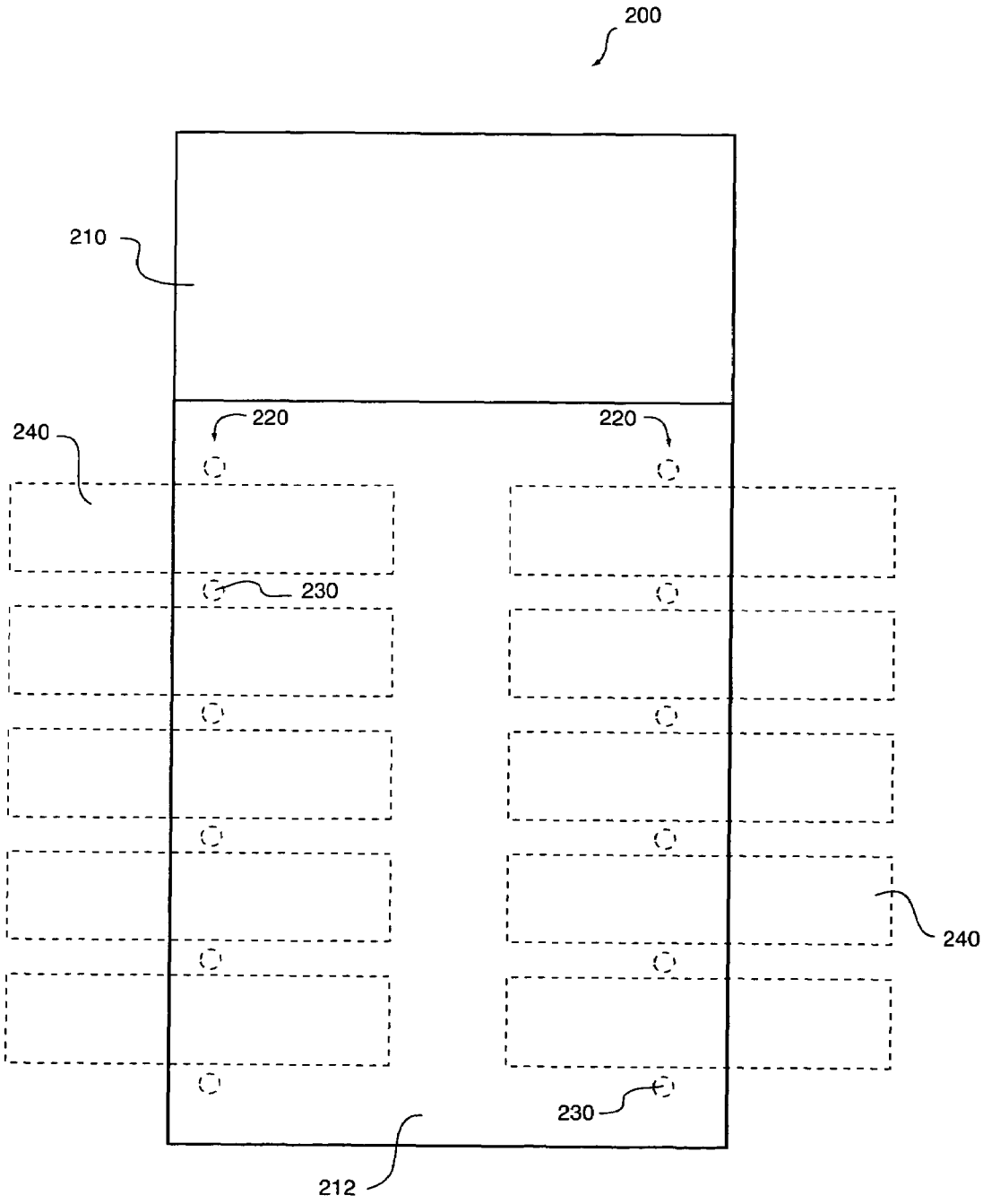
FIG. 2 is a front elevational view of another embodiment of a martial arts belt display rack in accordance with the present invention.

Referring now to FIG. 2, another embodiment of a martial arts belt display rack in accordance with the present invention is shown. In the embodiment illustrated in FIG. 2, belt rack 200 comprises a base placard 210 and a front placard 212 positioned at a set distance from the base placard. Two columns 220 of posts 230 secure the front placard to the base placard, and are set at a consistent distance apart horizontally and at a repeating interval vertically. In this embodiment, folded belts 240 can then be inserted between two consecutive posts 230 in one of columns 220 of posts 230 in such a fashion that part of folded belt 240 extends past the edge of the front placard allowing part of the belt to be seen. In addition, display rack 200 can include one or more mounting holes or brackets for mounting it to a wall, or the like.

In this embodiment front placard 212 has a rectangular shape. However, the shape of the front placard is not limited to this rectangular shape. Other possible shapes include, but are not limited to, circles, stars, octagons, semi-circles, or any other suitable shape. In addition, the front placard can be made of either transparent material(e.g., glass, Plexiglas or the like) or opaque material (e.g., wood, plastic, etc). Variations of these embodiments also allow for the inclusion of a transparent sheet (e.g., glass, Plexiglas or the like) affixed to the front placard for displaying a certificate of achievement, picture, etc. Examples of this are illustrated and described below in alternative embodiments.

Figure 3B:
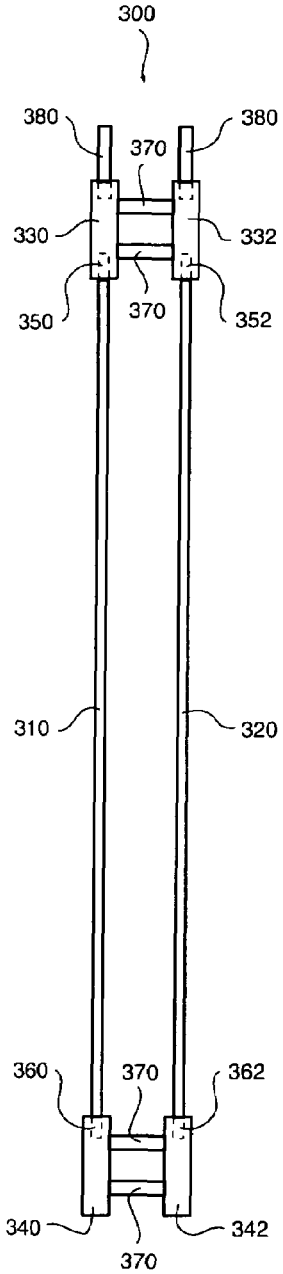
FIG. 3*b* is a side elevational view of the martial arts belt display rack of FIG. 3*a;*
Figure 3A:
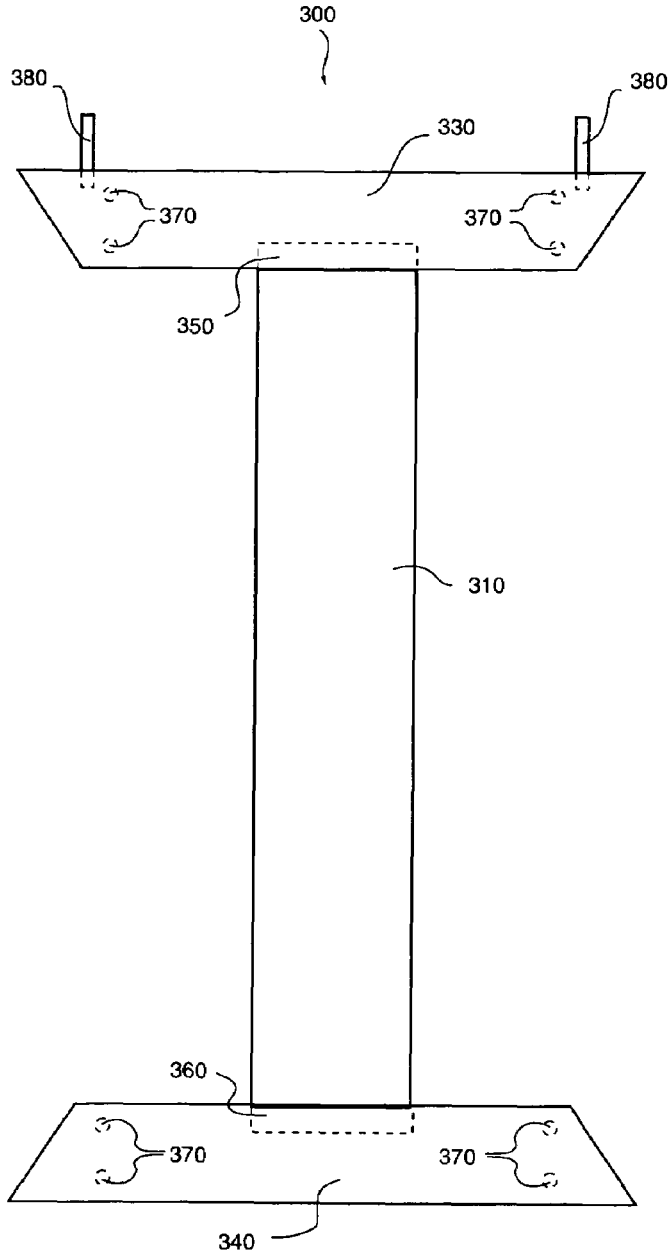
FIG. 3*a* is a front elevational view of yet another embodiment of a martial arts belt display rack in accordance with the present invention.

Referring now to FIGS. 3*a* and 3*b,* yet another embodiment of a martial arts belt display rack 300 in accordance with the present invention is shown. In the embodiment illustrated in FIGS. 3*a* and 3*b,* belt display rack 300 comprises a front placard 310, a back placard 320, a pair of top plates 330 and 332, and a pair of bottom plates 340 and 342. Top plates 330, 332 include notches 350 and 352, respectively, and bottom plates 340, 342 each have notches 360 and 362, respectively. Notches 350 and 360 are configured to receive and secure front placard 310, and notches 352 and 362 are configured to receive and secure rear placard 320. As illustrated in FIG. 3*b,* top plates 330 and 332 and bottom plates 340 and 342 can be secured a consistent distance apart using, for example, posts, dowels, or other fasteners 370, which in turn, also positions front placard 310 and back placard 320 a consistent distance apart. In the illustrated embodiment, four posts are used to secure the top plates 330, 332 and bottom plates 340, 342. One skilled in the art will appreciate, however, that any number of posts or fasteners can be used, and they can be spaced with any spacing or configuration.

In this particular embodiment, folded belts can be inserted between front placard 310 and back placard 320 and stacked one on top of another. The folded belts can be placed in a fashion such that part of the folded belts can extend past the edge of front placard 310 and/or back placard 320, allowing part of the belt to be seen. Further, as discussed above, front placard 310 and/or back placard 320 can be made from transparent or opaque materials. If transparent materials are used, the belts can be seen through the placards. Further, in another embodiment, top plates 330 and 332 can include posts 380, thus allowing a belt to be displayed by placing the belt between the posts across the top of the rack. In the illustrated embodiment, each of top plates 330 and 332 include two posts, but as one skilled in the art will appreciate, any number of posts can be used. In addition, display rack 300 can include mounting holes, similar to the mounting holes 108 found in FIG. 1*b,* or brackets for mounting it to a wall, or the like.

Figure 4B:
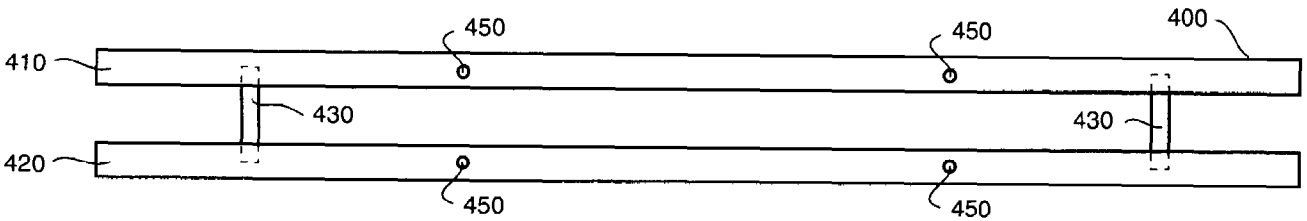
FIG. 4*b* is a top elevational view of the martial arts belt display rack of FIG. 4*a;*
Figure 4A:
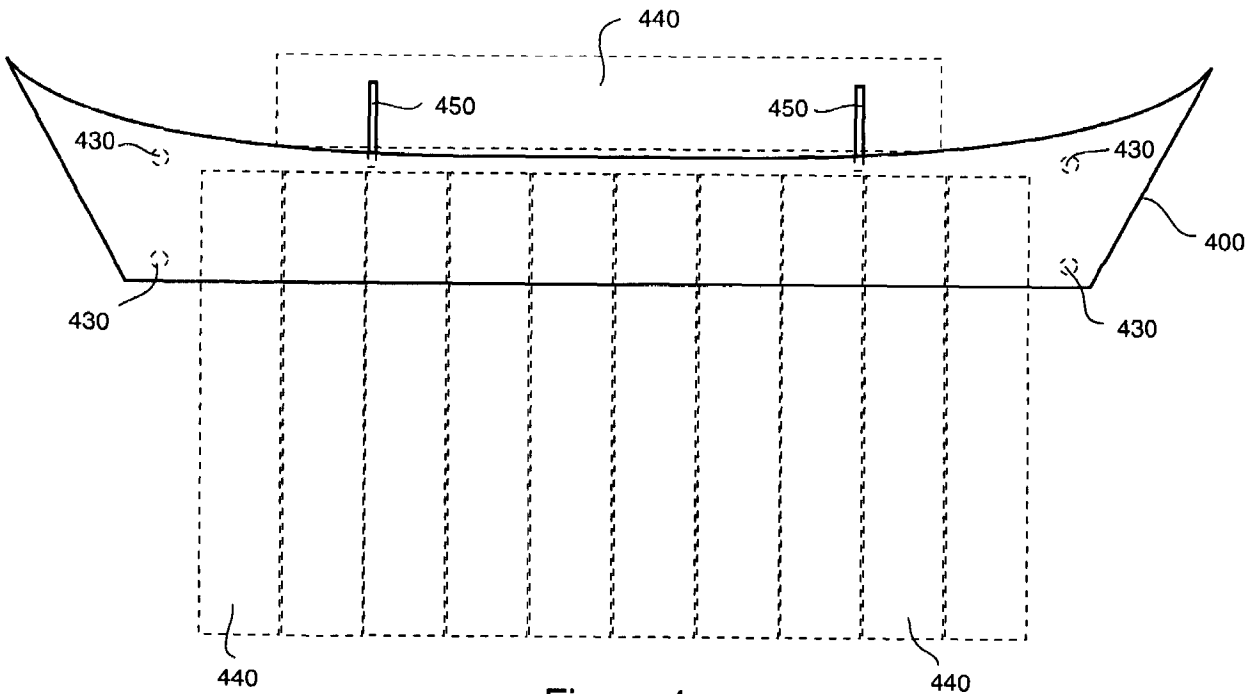
FIG. 4*a* is a front elevational view of still another embodiment of a martial arts belt display rack in accordance with the present invention.
Figure 4C:
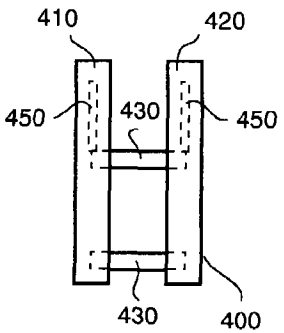
FIG. 4*c* is a side elevational view of the martial arts display rack of FIG. 4*a;*

Referring now to FIGS. 4*a*-4*c,* still another embodiment of a martial art belt display rack 400 in accordance with the present invention is shown. In the embodiment illustrated in FIGS. 4*a*-4*c,* belt display rack 400 comprises a front placard 410 and a rear placard 420. One or more posts 430 (e.g., four posts in the illustrated embodiment), secure front placard 410 to rear placard 420 at a consistent distance from each other. In some embodiments, posts 430 may be adjustable, so that the distance between the placards also is adjustable. In this particular embodiment, belts 440 can be placed between front placard 410 and rear placard 420 and are held vertically in place between the placards, for example, by compressing the belts between the placards. In some embodiments, the distance between the placards can be adjusted, so belts 440 can be tightly held between the placards. In addition, in some embodiments, front placard 410 and rear placard 420 may include posts 450, for securing a belt 440 between the posts across the top of the rack. In the illustrated embodiment, both placards 410, 420 include two posts each, but as one skilled in the art will appreciate, any number of posts can be used. In addition, display rack 400 can include mounting holes or brackets for mounting the rack to a wall or the like.

In the embodiment of FIGS. 4*a*-4*c,* the placards of the display rack are roughly boat-shaped or include pointed wings on each end. One skilled in the art will appreciate, however, that many other possible shapes of the placards can be used. For example, one or both of the placards can comprise shapes, such as, circles, semi-circles, stars, hexagons, or any other suitable shape. For example, FIGS. 5 and 6 illustrate display racks having semi-circular configurations.

Figure 5B:
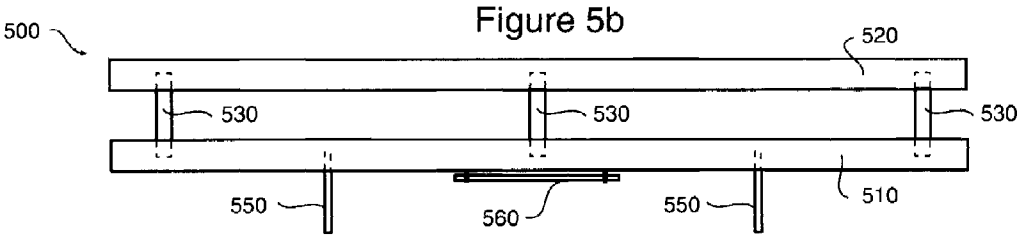
FIG. 5*b* is a top elevational view of the martial arts belt display rack of FIG. 5*a;*
Figure 5A:
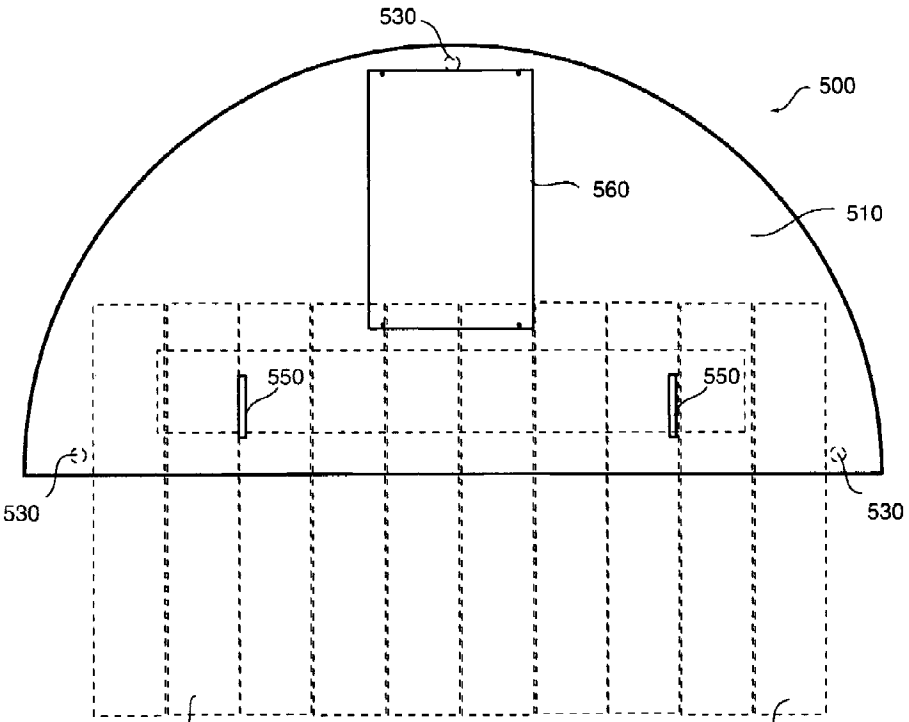
FIG. 5*a* is a front elevational view of still another embodiment of a martial arts belt display rack in accordance with the present invention.
Figure 5C:
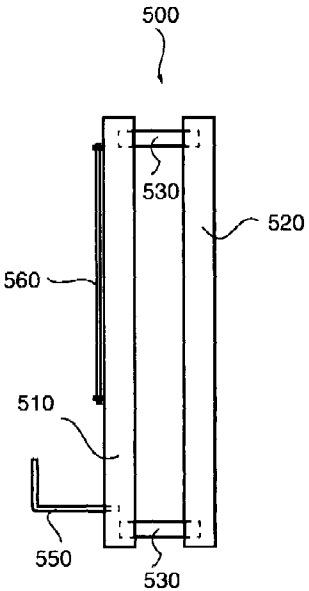
FIG. 5*c* is a side elevational view of the martial arts display rack of FIG. 5*a;*

In FIGS. 5*a*-5*c,* a semi-circular display rack 500 is shown, in which belts 540 are displayed in a vertical fashion similar to the embodiment illustrated in FIGS. 4*a*-4*c*. In this embodiment, display rack 500 comprises a front placard 510 and a rear placard 520 secured a distance apart with posts or fasteners 530. As with other embodiments, posts or fasteners 530 may be adjustable so that the distance between the placards also is adjustable. In addition, in the embodiment illustrated in FIGS. 5*a*-5*c,* display rack 500 can include posts or hooks 550 for holding an additional belt 540 across the front and/or top of the display rack. In the illustrated embodiment, hooks 550 positioned across front placard 510, but posts across the top (e.g., similar to posts 450 in FIGS. 4*a*-4*c*) also can be used. Further, display rack 500 can include a transparent sheet 560 (e.g., glass, Plexiglas or the like) affixed to the front placard for displaying a certificate of achievement, picture, etc. In this particular embodiment, belts 540 can be placed between front placard 510 and rear placard 520 and are held vertically in place between the placards, for example, by compressing the belts between the placards. In some embodiments, the distance between the placards can be adjusted, so belts 50 can be tightly held between the placards.

Figure 6B:
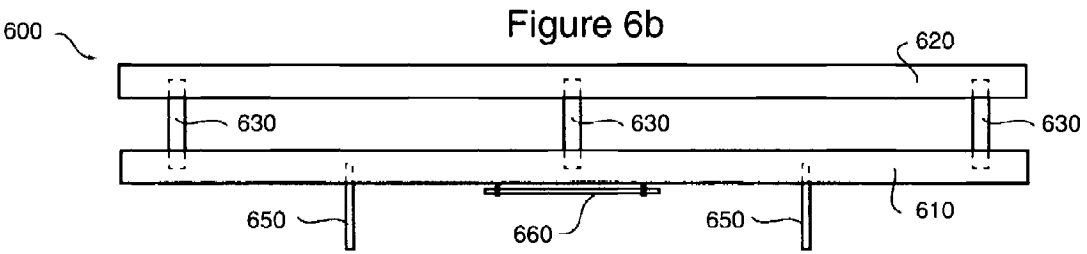
FIG. 6*b* is a top elevational view of the martial arts belt display rack of FIG. 6*a;*
Figure 6A:
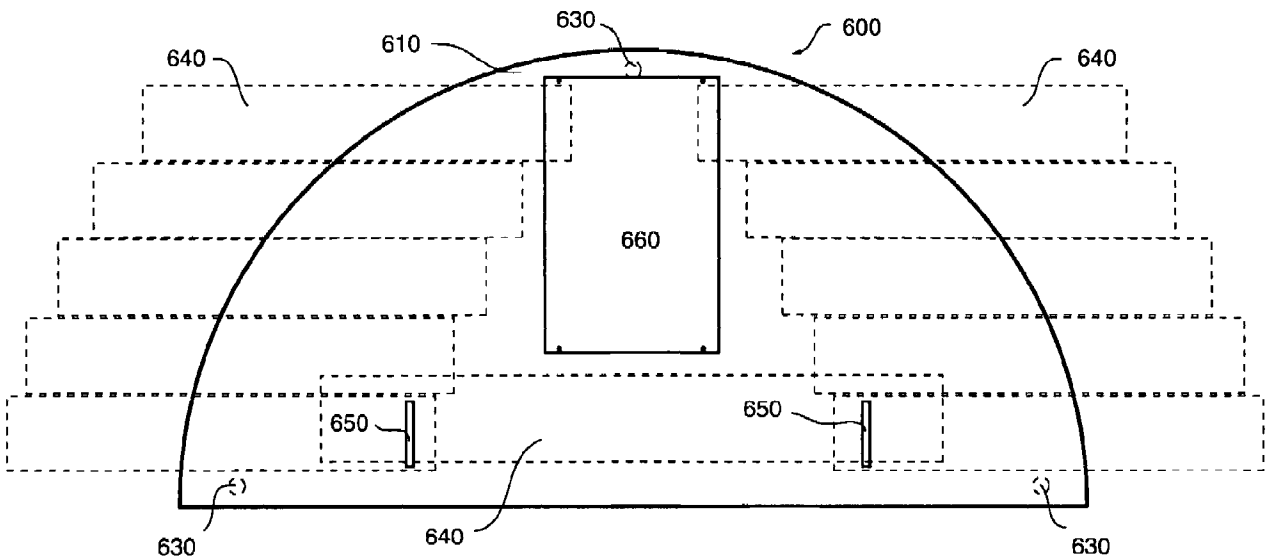
FIG. 6*a* is a front elevational view of still another embodiment of a martial arts belt display rack in accordance with the present invention.
Figure 6C:
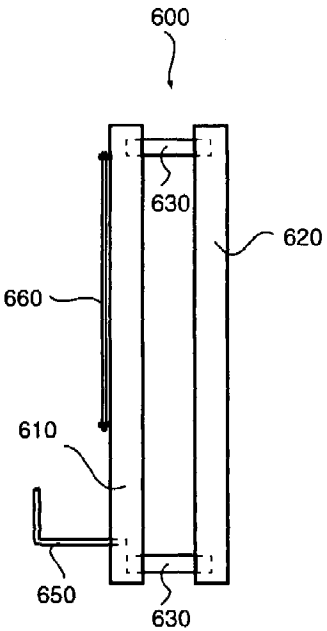
FIG. 6*c* is a side elevational view of the martial arts display rack of FIG. 6*a;*

In FIGS. 6*a*-6*c,* a semi-circular display rack 600 is shown, which is similar to the rack in FIGS. 5*a*-5*c* except that belts 640 are displayed horizontally in the rack instead of vertically. In this particular embodiment, display rack 600 comprises a front placard 610 and a rear placard 620 secured a distance apart with posts or fasteners 630. Again, as with other embodiments, posts or fasteners 630 may be adjustable so that the distance between the placards also is adjustable. In addition, as discussed above, display rack 600 can include posts or hooks 650 for holding an additional belt 640 across the front and/or top of the display rack, and/or a transparent sheet 660 (e.g., glass, Plexiglas or the like) affixed to front placard 610 for displaying a certificate of achievement, picture, etc. In this particular embodiment, folded belts 640 can be placed one on top of another between the two placards in such a fashion that a portion of the folded belts 640 extends past the edge of the front and/or rear placards.

Figure 7B:
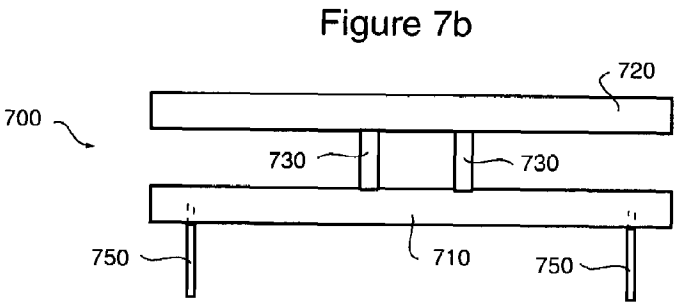
FIG. 7*b* is a top elevational view of the martial arts belt display rack of FIG. 7*a;*
Figure 7A:
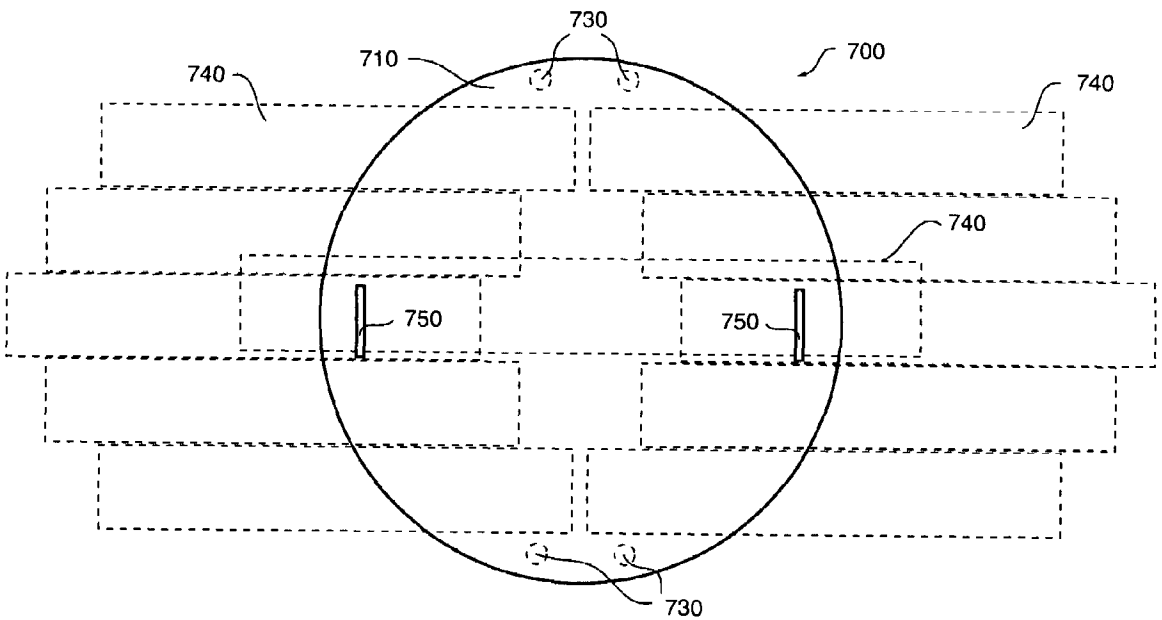
FIG. 7*a* is a front elevational view of still another embodiment of a martial arts belt display rack in accordance with the present invention.
Figure 7C:
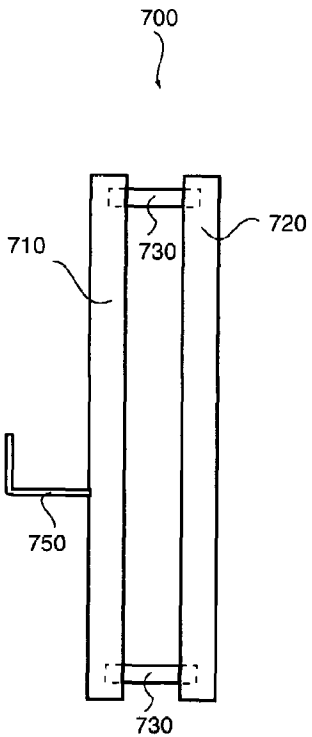
FIG. 7*c* is a side elevational view of the martial arts display rack of FIG. 7*a;*

Referring now to FIGS. 7*a*-7*c,* a circular display rack 700 is shown, which is similar to the rack in FIGS. 6*a*-6*c* except the rack is circular, instead of semi-circular. In this particular embodiment, belts 740 can be displayed horizontally. In this particular embodiment, display rack 700 comprises a front placard 710 and a rear placard 720 secured a distance apart with posts or fasteners 730. Again, as with other embodiments, posts or fasteners 730 may be adjustable, and display rack 700 can include posts or hooks 750 for holding an additional belt 740 across the front and/or top of the display rack. Further, as discussed above, display rack 700 can include a transparent sheet 760 (e.g., glass, Plexiglas or the like) affixed to front placard 710 for displaying a certificate of achievement, picture, etc. In this particular embodiment, folded belts 740 can be placed one on top of another between the two placards in such a fashion that a portion of the folded belts 740 extends past the edge of the front and/or rear placards.

Similar to the embodiment in FIGS. 7*a*-7*c*, FIGS. 8*a*-8*c* illustrated a circular display rack 800, but in this embodiment, belts 840 can be displayed vertically instead of horizontally. Thus, display rack 800 can include a front placard 810, a rear placard 820, posts or fasteners 830. Further, in alternative embodiments, display rack 800 can also include posts or hooks 850 and/or a transparent sheet 860, in much the same manner as with the embodiments discussed above. Finally, FIGS. 9*a*-9*c* illustrate yet another embodiment of a display rack 900 having a front placard 910 and/or a rear placard 920 that is star-shaped, or the like. Again, display rack 900 can have any or all of the features of the other display racks discussed herein, such as, for example, adjustable posts of fasteners 930, hooks or posts 950 and/or a transparent sheet 960. Further, in this particular embodiment, belts 940 can be secured in display rack 900 either horizontally or vertically.

In conclusion, the present invention provides novel designs for a martial arts belt display rack. While detailed descriptions of multiple embodiments of the invention have been given above, various alternatives, modifications, and equivalents will be apparent to those skilled in the art without varying from the spirit of the invention. Therefore, the above description should not be taken as limiting the scope of the invention, which is defined by the appended claims.

What is claimed is:

1. A martial arts belt display rack, comprising:

a first placard having a first face;

a second placard having a second face;

a plurality of posts arranged in columns positioned between the first face and the second face positioning the second placard a distance from the first placard;

wherein a martial arts belt is displayed in the rack by placing a folded martial arts belt between the first face and the second face and between two of the plurality of posts, and wherein a thickness of the folded martial arts belt makes the folded martial arts belt fit snugly when compressed between the first placard and the second placard; and wherein the first placard has a first height and a first width, the second placard has a second height and a second width, and the second height is smaller than the first height and the second width is smaller than the first width.

2. The display rack as recited in claim 1, wherein the first placard has a rectangular shape.

3. The display rack as recited in claim 1,wherein a bottom of the first placard is aligned with a bottom of the second placard, forming a base for placement on a substantially horizontal surface.

4. The display rack as recited in claim 1, wherein the middle of the width of the second placard is approximately centered with the middle of the width of the first placard.

5. The display rack as recited in claim 1, wherein the first placard includes at least one mounting hole for mounting the belt rack to a wall.

6. A martial arts belt display rack, comprising:

a first placard having a first face;

a second placard having a second face;

a plurality of posts arranged in columns positioned between the first face and the second face positioning the second placard a distance from the first placard; and a martial arts belt displayed in the rack by placing a folded martial arts belt between the first face and the second face and between two of the plurality of posts, and wherein the folded martial arts belt fits snugly compressed between the first placard and the second placard; and wherein the first placard has a first height and a first width, the second placard has a second height and a second width, and the second height is smaller than the first height and the second width is smaller than the first width.

7. The martial arts belt display rack of claim 6, wherein the posts are rigid posts which substantially prevent movement of the first placard with respect to the second placard and wherein the distance is a fixed distance.

8. The martial arts belt display rack of claim 6, wherein the first and second placards are in a face-to-face configuration.

* * * * *